United States Patent [19]

Rudszinat et al.

[11] 4,155,367

[45] May 22, 1979

[54] APPARATUS FOR PRODUCING A CONTINUOUS TOBACCO STREAM

[75] Inventors: Willy Rudszinat, Dassendorf; Günter Wahle, Reinbek, both of Fed. Rep. of Germany

[73] Assignee: Hauni-Werke Körber & Co. KG., Hamburg, Fed. Rep. of Germany

[21] Appl. No.: 783,799

[22] Filed: Apr. 1, 1977

[30] Foreign Application Priority Data

Apr. 21, 1976 [LU] Luxembourg ..... 74814

[51] Int. Cl.[2] ..... A24C 5/39; B65G 53/04; B30B 3/00

[52] U.S. Cl. ..... 131/843; 131/109 R; 131/109 B; 131/110; 100/153; 406/81; 406/82

[58] Field of Search ..... 131/20 R, 20 A, 21 R, 131/21 A, 21 B, 21 C, 22 R, 22 A, 23 R, 84 R, 84 A, 84 B, 84 C, 108, 109 R, 109 B, 110; 302/11-13, 28; 198/626, 627; 100/153; 318/432

[56] References Cited

U.S. PATENT DOCUMENTS

| | | | |
|---|---|---|---|
| 2,175,404 | 10/1939 | Leary | 131/108 |
| 2,488,844 | 11/1949 | Arelt | 131/109 |
| 2,535,667 | 12/1950 | Burger et al. | 318/432 |
| 3,026,878 | 3/1962 | Eissmann | 131/110 X |
| 3,276,452 | 10/1966 | Dearsley | 131/21 R |
| 3,871,385 | 3/1975 | David | 131/21 A |

FOREIGN PATENT DOCUMENTS

| | | | |
|---|---|---|---|
| 6865 of | 1903 | United Kingdom | 100/153 |

*Primary Examiner*—Robert W. Michell
*Assistant Examiner*—V. Millin
*Attorney, Agent, or Firm*—Peter K. Kontler

[57] ABSTRACT

A distributor for use in cigarette makers wherein an upright duct receives loose tobacco shreds and discharges the thus formed tobacco column into a compacting device therebelow. The compacting device has two endless belts whose inner reaches are located opposite each other and engage and compact the descending column of tobacco shreds. The belts receive constant torque from a motor by way of an electric clutch wherein the driving and driven elements are out of contact with each other. The densified column of tobacco shreds is fed into the space between two additional belts which are driven by the prime mover of the cigarette maker through the medium of a variable-speed transmission which is controlled by a density measuring device. The additional belts feed the column into the range of needles on a wheel which feeds tobacco shreds into several discrete pneumatic conveyor pipes or into a single pipe. The outlets of several pipes discharge discrete streamlets of loose tobacco shreds onto the upper reach of a foraminous belt conveyor in the stream building zone. The laminated stream which is formed on the foraminous belt is sufficiently uniform to be ready for wrapping without any or with negligible trimming. If the wheel delivers tobacco shreds to a single pipe, the shreds are caused to travel upwardly against the underside of a foraminous belt conveyor in the stream building zone.

23 Claims, 6 Drawing Figures

APPARATUS FOR PRODUCING A CONTINUOUS TOBACCO STREAM

BACKGROUND OF THE INVENTION

The present invention relates to apparatus for producing a continuous tobacco stream. Such apparatus may constitute distributors in cigarette rod making machines or in machines for the making of wrapped tobacco filler rods which are severed at regular intervals to yield plain cigarillos or cigars.

German Pat. No. 480,335 discloses a tobacco stream forming apparatus wherein a conveyor draws tobacco from a magazine and the thus withdrawn tobacco is fed into a duct which accumulates an intermediate supply of tobacco particles. The duct is followed by a device which compacts the particles of the intermediate supply and delivers compacted tobacco to a passage wherein the particles advance into the range of a conveyor for transfer of tobacco particles into the stream forming zone. The compacting device utilizes a wheel with retractible needles which draw tobacco particles from the duct and introduce the particles into the aforementioned passage. The wheel is mounted opposite a stationary wall of the compacting device. The purpose of the wheel is to insure uniform densification of tobacco which leaves the duct. To this end, the wheel is driven by an adjustable friction clutch. The means for delivering tobacco particles from the passage to the transfer conveyor comprises a carded drum and a picker roller which expels the particles from the carding. The picker roller breaks the particles of tobacco and produces large quantities of tobacco dust.

It has been found that the just described conventional apparatus cannot insure uniform compacting of tobacco particles between the duct and the passage. The German patent discloses that the wheel of the compacting device rotates at an irregular rate in that its speed decreases when a row of needles delivers a batch of tobacco particles into the passage because the batch encounters the mass of condensed tobacco particles in the passage. The driving element of the friction clutch then rotates relative to but continues to engage the driven element in order to insure that the freshly transferred batch is compacted to the same extent as the tobacco which is already received in the passage. The needles are thereupon retracted whereby the compacting action upon the freshly transferred batch decreases and the friction clutch is capable of increasing the rotational speed of the wheel. The just described mode of operation of the compacting device brings about alternating densification and expansion of tobacco in the passage whereby the variations in density of tobacco which advances in the passage entail irregular delivery of tobacco into the range of the carded drum. The fluctuations of density of tobacco in the passage between the compacting device and the carded drum are caused in part by retractible needles and in part by the periphery of the wheel because such periphery engages the adjacent particles and its speed varies for the aforedescribed reasons. Friction between the particles of tobacco and the stationary wall of the compacting device is not constant, and this also contributes to unpredictability of compacting action upon tobacco which is transported from the duct into the passage upstream of the carded drum. As a rule, friction between tobacco and a stationary wall will depend on the nature of tobacco as well as on the moisture content of tobacco particles.

The factors which influence densification of tobacco particles in the patented apparatus are so unpredictable that such apparatus failed to gain acceptance in the tobacco processing industry.

OBJECTS AND SUMMARY OF THE INVENTION

An object of the invention is to provide a novel and improved tobacco stream forming apparatus wherein the mass of tobacco particles which are transported from a source to the stream forming station can be compacted with a high degree of reproducibility and in a simple, inexpensive and space-saving manner.

Another obejct of the invention is to provide the apparatus with novel and improved compacting or condensing means for tobacco particles which are caused to advance from a magazine to the conveyor of the stream forming unit in a machine for the production of cigarettes, cigarillos or cigars.

An additional object of the invention is to provide a novel and improved distributor for use in cigarette rod making machines or the like.

A further object of the invention is to provide novel and improved means for transferring uniformly compacted tobacco to the stream forming station.

An ancillary object of the invention is to provide novel and improved pneumatic conveyors which enable the stream forming unit to produce a laminated tobacco stream which is sufficiently uniform to be ready for draping into cigarette paper without any or with negligible equalization upstream of the wrapping station.

Another object of the invention is to provide a tobacco stream forming apparatus which does not break the particles and produces negligible quantities of tobacco dust.

The invention is embodied in an apparatus for producing a continuous tobacco stream. The apparatus comprises a magazine or an analogous source of tobacco particles, means for continuously transporting tobacco particles (or at least the lightweight particles of a mixture of heavier and lighter particles) from the source into a preferably upright duct wherein the particles form an intermediate supply (i.e., an upright column if the duct is vertical), means for condensing successive increments of the intermediate supply including conveyor means having a rotary member and means for transmitting to the rotary member a substantially constant torque (the conveyor means of the condensing means may include two endless belts or analogous flexible elements which flank a passage for tobacco particles and receive torque from a motor through the medium of an electric clutch wherein the driving and driven clutch elements are out of contact with each other), a packing device or analogous means for receiving compacted tobacco particles from the condensing means and including a plurality of endless belts or analogous flexible elements defining a passage wherein the particles advance in a predetermined direction (i.e., downwardly if the compacting means is located below the duct and the receiving means is located below the compacting means), stream forming means including a preferably foraminous conveyor which transports the stream in a given direction toward and into the wrapping mechanism of a cigarette maker or the like, and a prime mover or analogous means for driving the conveyor of the stream forming means and the flexible elements of the receiving means independently of the conveyor means which forms part of the compacting means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1A:
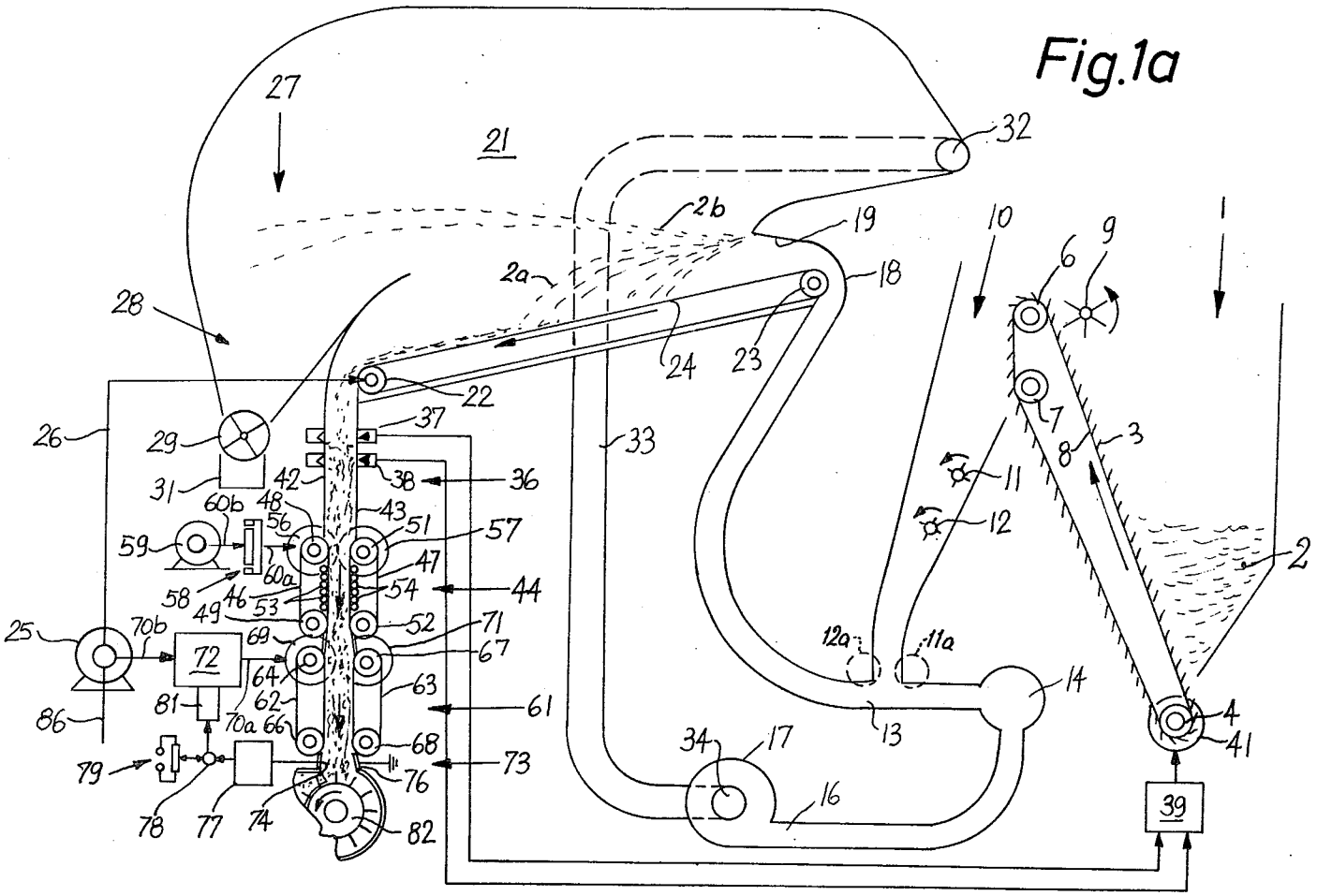
FIG. 1*a* is a schematic partly elevational and partly vertical sectional view of a first portion of an apparatus which embodies one form of the invention.

Referring first to FIG. 1*a,* there is shown a first portion of an apparatus which embodies one form of the invention. The apparatus comprises a magazine 1 which constitutes a source of supply of tobacco 2. The contents of the magazine 1 constitute a mixture of lightweight tobacco particles (primarily shredded tobacco leaf laminae) and heavier tobacco particles (including fragments of stem, ribs, birds' eyes and possibly some foreign matter, such as particles of metal). The left-hand side wall of the magazine 1, as viewed in FIG. 1*a,* constitutes one stretch or reach of an endless carded tobacco withdrawing belt conveyor 8 which is provided with external tobacco entraining or withdrawing projections 3 in the form of pins or the like and is trained over rollers 4, 6 and 7. The roller 4 is driven by a variable-speed motor 41 whose speed determines the rate at which the pins 3 withdraw a continuous and rather wide layer of tobacco particles from the magazine 1. A driven paddle wheel 9 or an analogous refuser is provided close to the upper end of the conveyor 8 to effect at least some equalization of the layer which is caused to pass around the uppermost roller 6 and descends into a substantially upright hopper 10 containing rotary agitating devices 11, 12 in the form of rolls having radially outwardly extending studs or analogous projections. The agitating devices 11, 12 are rotated (either in a single direction or back and forth) at a relatively low speed to reduce the likelihood of comminution of tobacco particles in the hopper 10, The outlet at the lower end of the hopper 10 communicates with a pneumatic conveyor pipe 13 which is connected with the outlet 16 of a blower 17 (or an analogous source of compressed air) by an air distributor 14. If desired, the outlet at the lower end of the hopper 10 can be flanked by auxiliary agitating devices 11*a,* 12*a* (indicated by broken lines) which reduce the likelihood of clogging of the lower end with clumps or similar agglomerations of tobacco particles.

The discharge end or outlet of the pneumatic conveyor pipe 13 constitutes an elbow 18 which discharges a shower of tobacco particles and the gaseous carrier medium into a relatively large domed classifying chamber 21. The latter comprises a baffle 19 which is disposed above the discharge opening of the elbow 18 and directs the shower of tobacco particles into the interior of the chamber 21. The flight spans of lightweight particles 2*a* are shorter than the flight spans of heavier particles 2*b;* therefore, the lightweight particles 2*a* descend onto and form a carpet on the upper reach of a wide endless conveyor band 24 which is trained over rollers 22 and 23. The heavier particles 2*b* are propelled into an intercepting and evacuating device 27 having a funnel 28, a cell wheel 29 or an analogous air lock at the lower end of the funnel 28, and a take-off conveyor 31 (e.g., a vibratory conveyor) which removes the particles 2*b.* Such particles can be fed to an apparatus for the making of sheets of reconstituted tobacco. The wheel 29 transfers the particles 2*b* from the funnel 28 into or onto the conveyor 31 but prevents the escape of appreciable quantities of air.

The parts 8, 13, 24 together constitute a transporting unit which continuously feeds lightweight particles 2*a* from the magazine 1 toward and beyond the discharge end (above the roller 22) of the conveyor band 24.

That portion of the classifying chamber 21 which is located above and behind the baffle 19 has an air outlet 32 which is connected to the intake 34 of the blower 17 by a conduit 33.

The front roller 22 for the conveyor 24 receives motion from the main prime mover 25 (e.g., an electric motor) of the apparatus. This prime mover preferably constitutes the prime mover of the cigarette making machine or of the cigarette making machine and the filter cigarette maker which is operatively connected therewith. The torque-transmitting connection between the prime mover 25 and the roller 22 is indicated by the line 26.

The apparatus further comprises an upright duct 36 which receives lighter tobacco particles 2*a* from the discharge end of the conveyor 24 and causes such particles to form an upright intermediate supply or column. The upper level of the column of particles 2*a* in the duct 36 is monitored by a level detector including an upper photoelectric cell 37 and a lower photoelectric cell 38. The transducers of the cells 37, 38 are connected to the corresponding inputs of a speed regulating unit 39 for the variable-speed motor 41 which drives the carded conveyor 8. The regulating unit 39 causes the motor 41 to reduce the speed of the conveyor 8 when the upper level of the column of particles 2*a* in the duct 36 rises sufficiently to interrupt the light beam between the light source and the transducer of the upper cell 37, and the regulating unit 39 increases the speed of the motor 41 when the upper level of the column descends below the light beam which issues from the light source of the lower cell 38. In this way, the level detector 37, 38 insures that the height of the column in the duct 36 remains constant or fluctuates only within a relatively narrow range which is determined by the selected positions of the cells 37 and 38. Full details of the just described combination of a level detector and motor for the conveyor which draws tobacco particles from a magazine are disclosed in commonly owned U.S. Pat. No. 3,903,901 granted Sept. 9, 1975 to Wochnowski.

The side walls 42 and 43 of the duct 36 diverge slightly in a downward direction, i.e., away from the discharge end of the conveyor 24. The duct 36 is followed by a compacting or condensing device 44 which includes conveyor means having two endless belts or analogous flexible elements 46 and 47. The distance between the inner reaches of the belts 46, 47 is somewhat less than the distance between the lower ends of the side walls 42 and 43 so that successive increments of the lower portion of the column which descends in the duct 36 are compacted or densified during travel in the passage between the belts 46, 47. The inner reaches of these belts travel downwardly, as viewed in FIG. 1*a*, and their outer sides or surfaces are propped by back supports respectively including upright rows of small horizontal rolls 53, 54. The belts 46, 47 are respectively trained over rollers or pulleys 48, 49 and 51, 52. The aforementioned reduction of the width of the path for the column of particles 2*a* between the duct 36 and the compacting device 44 insures that the belts 46, 47 positively engage and transport the column downwardly toward and beyond the lower rollers 49, 52. The upper rollers 48, 51 are respectively rigid and coaxial with two rotary members here shown as mating gears 56, 57. The gear 56 receives torque from a discrete motor 59 through the medium of an electric clutch 58 of the type wherein the driving and driven clutch elements are never in frictional contact with each other. This insures that the torque which is transmitted to the rotary member or gear 56 is constant. The clutch 58 may be a commercially available eddy current or hysteresis clutch. The operative connections between the output element of the motor 59 and the driving element of the clutch 58 on the one hand, and the driven element of the clutch 58 and the gear 56 on the other hand, are respectively denoted by the lines 60*b*, 60*a*.

The compacting device 44 is located immediately above a tobacco receiving and packing device 61 having two endless belts or analogous flexible elements 62, 63 which are disposed opposite each other and are respectively trained over rollers 64, 66 and 67, 68. The distance between the inner reaches of the belts 62, 63 preferably slightly exceeds the distance between the inner reaches of the belts 46, 47. The upper rollers 64, 67 are respectively rigid and coaxial with rotary members here shown as mating gears 69, 71. The gear 69 receives torque from the prime mover 25 by way of an infinitely-variable-speed transmission 72. The operative connections between the prime mover 25 and transmission 72 on the one hand, and the transmission 72 and gear 69 on the other hand, are respectively denoted by lines 70*b* and 70*a*.

The passage between the belts 62, 63 of the receiving device 61 discharges successive increments of the compacted tobacco column into a mouthpiece or nipple 73 which carries the electrodes 74, 76 of a capacitive density measuring device 77 whose output transmits signals (representing the density of successive increments of the compacted column) to the corresponding input of a signal comparing junction 78. Another input of the junction 78 is connected with a source 79 of reference signals (e.g., an adjustable potentiometer), and the output of the junction 78 transmits a signal to a servomotor 81 when the intensity of the reference signal deviates from the intensity of signal at the output of the measuring device 77. The servomotor 81 then adjusts the transmission 72 accordingly, i.e., the speed of the belts 62, 63 is increased if the measured value of density is too low, and vice versa.

The mouthpiece 73 is located immediately above and delivers the densified column of tobacco particles 2*a* into the range of orbiting needles or analogous projections of a rotating tobacco loosening wheel 82 which is driven by the prime mover 25 and delivers particles 2*a* to a tobacco transferring unit 83 (FIG. 1*b*) for transport onto the upper reach of an air-permeable endless belt conveyor 84 forming part of the tobacco stream forming mechanism. The conveyor 84 is trained over several rollers including a roller 87 which is driven by the prime mover 25 (the operative connection between this prime mover and the roller 87 is indicated by the line 86). The space between the upper and lower reaches of the conveyor 84 receives an elongated suction chamber 88 which is located immediately below the upper reach and is open at the top so that it attracts tobacco particles to the upper side of the upper reach. The upper reach of the conveyor 84 constitutes the foraminous bottom wall of an elongated narrow tobacco channel or trough 89 wherein the growing tobacco stream advances in a direction to the left, as viewed in FIG. 1*b*. The fully grown stream is shown at 90.

Figures 1B, 2, 3, 4:
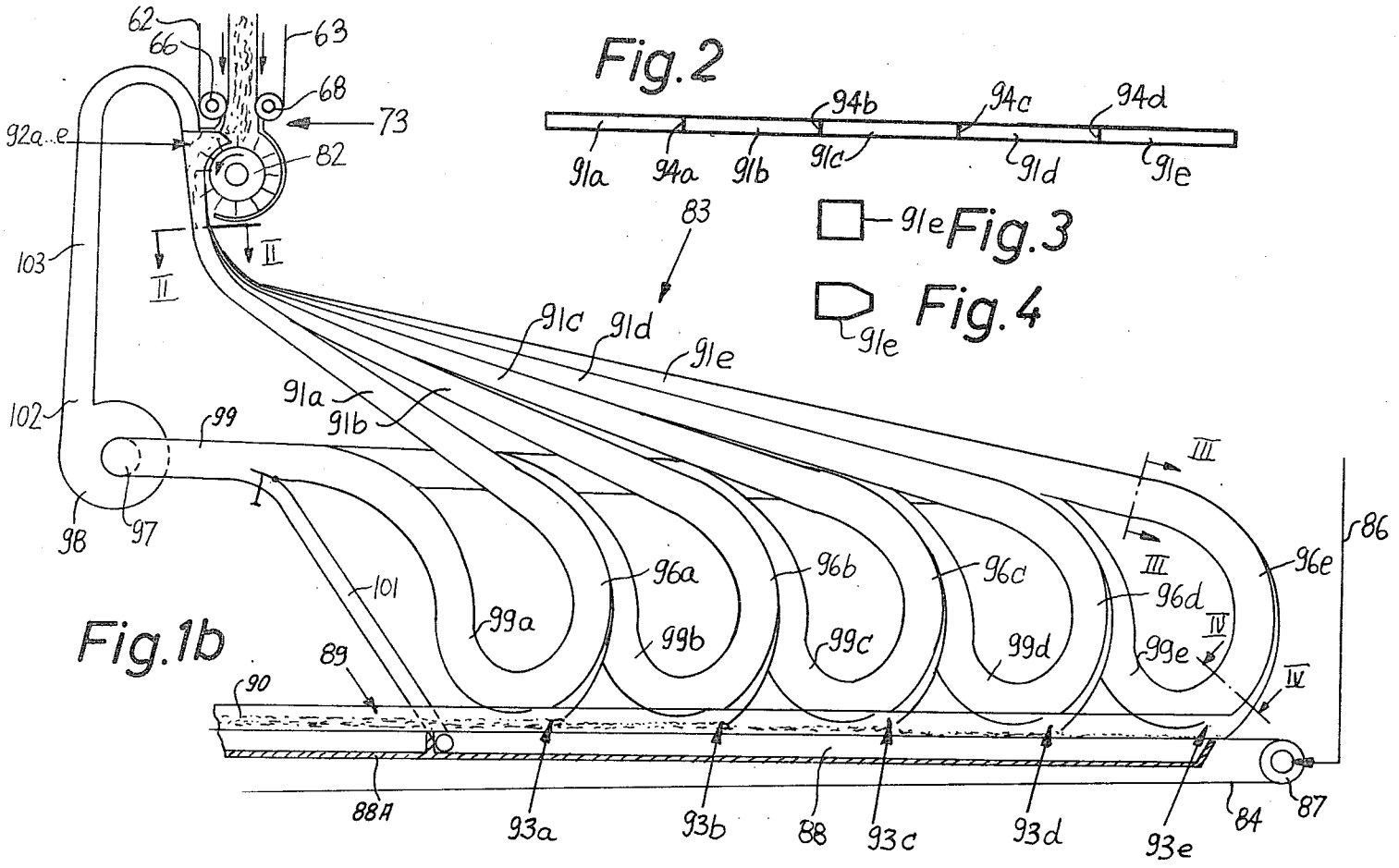
FIG. 1*b* is a similar partly elevational and partly vertical sectional view of the remaining portion of the apparatus.
FIG. 2 is a sectional view as seen in the direction of arrows from the line II—II of FIG. 1*b;*
FIG. 3 is a sectional view as seen in the direction of arrows from the line III—III of FIG. 1*b;*
FIG. 4 is a sectional view as seen in the direction of arrows from the line IV—IV of FIG. 1*b.

The transferring unit 83 comprises several pneumatic conveyor pipes 91*a*, 91*b*, 91*c*, 91*d*, 91*e* whose inlets 92*a*–92*e* are adjacent to each other and form a row extending at right angles to the plane of FIG. 1*b*, i.e., in parallelism with the axis of the wheel 82. The combined width of the inlets 92*a*–92*e* equals the width of the passage between the belts 62, 63 and hence the width of the passage between the belts 46, 47, the width of the side walls 42, 43, the width of the conveyor 24, and the axial length of the wheel 82. The combined width of the pipes 91*a*–91*e* at the respective inlets 92*a*–92*e* is shown in FIG. 2. The neighboring pipes 91*a*–91*e* are separated from each other by partitions 94*a*, 94*b*, 94*c*, 94*d*. The inlets 92*a*–92*e* are immediately adjacent to and receive tobacco particles 2*a* from the needles of the wheel 82.

The outlets 93*a*–93*e* of the pipes 91*a*–91*e* are disposed one behind the other, as considered in the longitudinal direction of the conveyor 84. Thus, the outlets 93*e*, 93*d*, 93*c*, 93*b* respectively discharge tobacco particles 2*a* onto the upper reach of the belt conveyor 84 upstream of the outlets 93*d*, 93*c*, 93*b*, 93*a*. These outlets discharge tobacco particles 2*a* into the space between the side walls of the trough 89.

The sections of pipes 91*a*–91*e* immediately upstream of the respective outlets 93*a*–93*e* are suitably curved, as at 96*a*–96*e*, so that the particles 2*a* leave the pipes 91*a*–91*e* under the action of centrifugal force by advancing along the concave internal surfaces of the respective sections 96*a*–96*e* to descend onto the upper reach of the conveyor 84. The outlet portions 99*a*–99*e* of the pipes 91*a*–91*e* are connected to the intake 97 of a blower 98 whose outlet 102 is connected with the inlets 92*a*–92*e* by a conduit 103. As shown, the outlet portions 99*a*–99*e* of all five pipes 91*a*–91*e* can merge into a single air collecting pipe 99 which admits air to the intake 97. A suction pipe 101 connects the left-hand end of the suction chamber 88 with the pipe 99 so that the blower 98 draws air from the suction chamber 88 and insures that the particles 2*a* adhere to the upper reach of the conveyor 84 during travel in the trough 89.

FIGS. 2 and 3 show that the upstream portion of each of the pipes 91*a*–91*e* has a rectangular cross-sectional outline in the region of and downstream of the respective inlet (92*a*–92*e*), and that the cross-section of each pipe is square or nearly square upstream of the respective outlet (93*a*–93*e*). The outlets 96*a*–96*e* have a different outlet (see FIG. 4), i.e., the width of the tobacco-conveying portions of the outlets 93a–93e is less than the width of the air-conveying portions. The narrower portion of the cross-section shown in FIG. 4 extends into the trough 89. The cross-sectional area of each of the pipes 91a–91e is constant and the transition from the outline of FIG. 3 into the outline of FIG. 4 is gradual.

The operation is as follows:

The pins 3 of the conveyor 8 draw a mixture of tobacco particles 2a and 2b from the magazine 1 at a rate which is determined by the speed of the motor 41, i.e., by the level of the intermediate supply or column of tobacco particles 2a in the duct 36. The elastic paddles of the refuser wheel 9 perform a preliminary equalizing action, and the thus equalized layer of tobacco particles is discharged into the hopper 10 to be agitated by the devices 11a, 12a and/or 11, 12 prior to entering the pneumatic conveyor pipe 13. The agitating action of devices 11a, 12a and/or 11, 12 suffices to insure that the pipe 13 receives loose tobacco particles. The rapidly flowing current of air in the pipe 13 entrains the particles and transports them upwardly toward and into the elbow 18. The baffle 19 directs the particles into the interior of the classifying chamber 21 wherein the lighter particles 2a are separated from heavier particles 2b in the aforedescribed manner and form a wide carpet on the upper reach of the conveyor band 24. The current of air which flows from the elbow 18 into the chamber 21 does not interfere with segregation of particles 2a from the particles 2b because the speed of the air current decreases very pronouncedly immediately upon entry into the large-volume chamber 21. The kinetic energy of heavier particles 2b suffices to carry them into the funnel 28 from which the particles 2b are evacuated into the take-off conveyor 31 through the cell wheel 29. The outlet 32 (which is remote from the duct 36) admits air into the conduit 33 wherein the air flows back toward and into the intake 34 of the blower 17. The latter performs the function of a pump which circulates air along a closed path defined by the pipe 13, chamber 21 and conduit 33.

The lighter particles 2a advance with the upper reach of the conveyor band 24 and are discharged into the duct 36 to form the aforementioned intermediate supply or column whose level is monitored by the cells 37 and 38. These cells cooperate with the speed regulating unit 39, motor 41 and carded conveyor 8 to insure that the height of the column in the duct 36 remains at least substantially constant. The belts 46, 47 entrain and compact successive increments of the descending column in the duct 36 and cause the thus condensed narrow but wide mass of condensed particles 2a to enter the receiving device 61. Since the clutch 58 invariably transmits a constant torque, the force with which the belts 46, 47 feed tobacco particles 2a into the receiving device 61 is also constant. If the conditions in the device 61 change, the slip between the driving and driven elements of the clutch 58 changes accordingly.

The particles which enter the space between the belts 62, 63 are permitted to expand and are transported into the range of needles on the rotating loosening wheel 82 at a rate which is proportional to the speed of the output element of the prime mover 25. Note that the latter drives the gears 69, 71 for the upper rollers 64, 67 of the belts 62, 63.

Eventual variations or fluctuations of the density of the mass of tobacco particles 2a which pass through the mouthpiece 73 are detected by the receiving device 77 which causes the servomotor 81 to change the speed of the transmission 72 and to thus compensate for such fluctuations. This insures that the device 61 delivers to the needles of the wheel 82 identical quantities of tobacco particles 2a per unit of time.

The wheel 82 feeds loose tobacco particles 2a into the inlets 92a–92e of the pipes 91a–91e whereby the particles are entrained by the currents of air flowing from the inlets 92a–92e toward the outlets 93a–93e. During travel in the respective arcuate sections 96a–96e, the particles 2a are segregated from the air currents and descend into the trough 89 to be entrained and advanced by the upper reach of the conveyor 84. The segregated air currents flow in the portions 99a–99e, in the collecting pipe 99 and back to the intake 97 of the blower 98 which compresses the air and delivers compressed air into the conduit 103.

The outlets 93a–93e discharge relatively narrow and thin streamlets of particles 2a; such streamlets overlie each other in the trough 89 and ultimately form a narrow stream 90 of requisite height to be advanced into the wrapping mechanism of a cigarette making machine. The manner in which the laminated tobacco stream 90 is draped into cigarette paper and converted into plain cigarettes of unit length or multiple unit length forms no part of the invention.

Some air flows through the outlets 93a–93e and passes through the perforations of the conveyor 84 on its way into the suction chamber 88. Such air flows toward and in the pipe 101, i.e., back to the intake 97 of the blower 96. The purpose of the suction chamber 88 is to attract the particles 2a to the outer side of the upper reach of the conveyor 84 and to thus prevent eventual shifting and/or rebounding of particles on their way toward the wrapping mechanism of the cigarette maker.

The suction chamber 88A to the left of the chamber 88 is preferably connected with a discrete suction generating device (not shown) which insures that the left-hand portion of the upper reach of the conveyor 84 attracts the fully grown tobacco stream 90 during transport all the way to the wrapping station of the cigarette maker. The provision of a separate suction generating device for the chamber 88A is advantageous because this insures that the transferring unit 83 circulates air in a closed pneumatic system from the outlet 102 to the intake 97 of the blower 96.

A desirable feature of the improved apparatus is that the speed of the belts 62, 63 in the receiving device 61 can be regulated independently of the speed of the loosening wheel 82. This insures that the device 61 can deliver required quantities of tobacco particles 2a into the range of orbiting needles on the wheel 82. Moreover, the densification of tobacco particles in the passage between the belts 62, 63 of the receiving device 61 is not dependent on the rate at which the needles of the wheel 82 deliver tobacco particles to the inlets 92a–92e of the pipes 91a–91e. As a rule, the desired densification of the column of tobacco particles 2a which leave the compacting device 44 is reached at the upper end of the passage between the belts 62, 63, and the belts 62, 63 insure that such optimum densification remains intact during transport into the range of the needles on the wheel 82. In other words, the passage between the belts 62, 63 contains a column or slab of tobacco particles 2a which are densified to the optimum extent and such slab advances toward the wheel 82 at the speed which is determined by the setting of transmission 72 in dependency on the presence or absence (or sign) of the signal at the output of the junction 78.

The aforedescribed construction of the compacting device 44 also contributes to uniform density of tobacco which issues from the passage between the belts 62, 63 of the receiving device 61. The belts 46, 47 engage the column of tobacco particles 2a from opposite sides and urge the particles toward the device 61 with a constant force. This eliminates the possibility or likelihood of pulsating changes in the density of tobacco which reaches the wheel 82. The densifying or compacting action is achieved by placing the inner reaches of the belts 46, 47 nearer to each other than the distance between the lower ends of the side walls 42, 43. Such densifying action need not be very pronounced; this enables the transmission 58 to furnish a constant torque in spite of eventual minor friction which develops between the moving parts of the device 44.

Excessive compacting is prevented if the tension of belts 46, 47 is relatively low so that their inner reaches can yield to the pressure of the column of particles 2a which advance from the open lower end of the duct 36 toward the passage between the belts 62, 63. Such loose mounting of belts 46, 47 necessitates (or renders desirable) the provision of back supports 53, 54 for the outer sides of their inner reaches. Back supports which include or consist of rolls insure that friction between the inner reaches of the belts 46, 47 and the respective back supports is negligible.

As mentioned before, the apparatus which is disclosed in German Pat. No. 480,335 employs a friction clutch for the wheel of the compacting device. In such clutches, the magnitude of transmitted torque depends on the friction factor of the clutch, and such factor varies with progressing wear upon the elements of the clutch. Moreover, the just mentioned factor depends on the moisture of surrounding air as well as on certain other parameters. Therefore, the torque which is transmitted by a friction clutch often varies at a highly unpredictable rate. Such problems are solved by the utilization of a clutch (58) wherein the magnitude of transmitted torque is not dependent on the friction factor, moisture content of surrounding air and/or other unpredictable variables.

As also mentioned before, the level detector including the cells 37, 38, in combination with regulating unit 39 for the motor 41, also contributes to more satisfactory and predictable densification of tobacco particles in the device 44. It has been found that the compacting action of belts 46, 47 is more satisfactory if the height of the column of particles 2a in the duct 36 is constant or fluctuates only within a narrow range, such as can be selected in advance by appropriate positioning of the cells 37 and 38.

The provision of classifying means including the chamber 21 and baffle 19 also contributes to predictable densification of tobacco particles in the device 44. Such classifying means performs several important functions. Thus, the heavier particles 2b (which are likely to puncture the cigarette paper web in the wrapping mechanism of a cigarette rod maker) are segregated upstream of the duct 36. Secondly, the compacting action is more uniform if the consistency of all particles (2a) which form the descending column between the side walls 42, 43 is identical or practically identical (i.e., if the particles 2a constitute relatively long shreds of tobacco leaf laminae). Still further, classification in the chamber 21 results in automatic separation of all or nearly all particles from each other. Thus, the lighter particles 2a on the conveyor band 24 are not likely to be interlaced with each other so that, after entering the duct 36, they form a column whose density is nearly constant in all zones thereof. This, in turn, insures reproducible densification in the device 44. As a rule, the quality of the stream 90 is invariably higher if the stream consists of particles which were fully separated from each other before they reach the conveyor 84, in spite of densification in the device 44 (because such densification is uniform and is followed by pronounced loosening during transfer from the mouthpiece 73 into the trough 89).

The provision of pneumatic conveyor pipe 13 is desirable and advantageous because such pipe replaces conventional picker rollers and/or winnowers which are much more likely to comminute the particles 2a during transport from the conveyor 8 into the duct 36. The speed of the air current in the pipe 13 can be readily selected in such a way that the kinetic energy of particles entering the chamber 21 via outlet 18 of the pipe 13 suffices to insure reliable separation of heavier particles 2b from lightweight particles 2a.

The placing of the open upper end of the duct 36 immediately below the conveyor band 24 contributes to compactness of the apparatus.

The needles of the wheel 82 do not perform any tobacco comminuting action. These needles merely paddle successive increments of the column which passes through the mouthpiece 73 into the inlets 92a–92e of the pipes 91a–91e without any comminuting action. The pipes 91a–91e cooperate with the stream forming means 84, 88, 89 to convert the relatively wide but thin shower of particles 2a which are delivered by the wheel 82 into a narrow stream which is fully grown immediately downstream of the outlet 93a. Such conversion is due to the fact that the narrow but wide inlets 92a–92e form a row (FIG. 2) which is parallel to the axis of the wheel 82 and is immediately or closely adjacent a portion of the path of needles on the wheel 82, and that the outlets 93a–93e are staggered with respect to each other, as considered in the direction of tobacco transport on the upper reach of the conveyor 84. The laminated stream 90 is so uniform that it can be wrapped without any trimming or is sufficiently uniform to insure that its exposed side does not exhibit any pronounced hills and valleys which are typical of tobacco streams formed in conventional distributors. High quality of the stream 90 is also attributable to the fact that the particles 2a in the pipes 91a–91e are fully separated from each other so that the streamlets of tobacco issuing from the outlets 93a–93e are actually thin showers of discrete particles. The contents of such showers can be distributed along the full width of the trough 89 with a much higher degree of uniformity than streamlets which consist of or include coherent (interlaced) tobacco shreds. The energy requirements of the pneumatic conveyor means including the pipes 91a–91e are relatively low because all such pipes can receive currents of air from a common source (blower 98). The curvature of outlets 93a–93e is selected in such a way that the particles 2a which issue from the pipes 91a–91e have a component of movement in the direction of forward movement of the upper reach of the conveyor 84; this reduces the likelihood of rebounding of particles which enter the trough 89.

Figure 5:
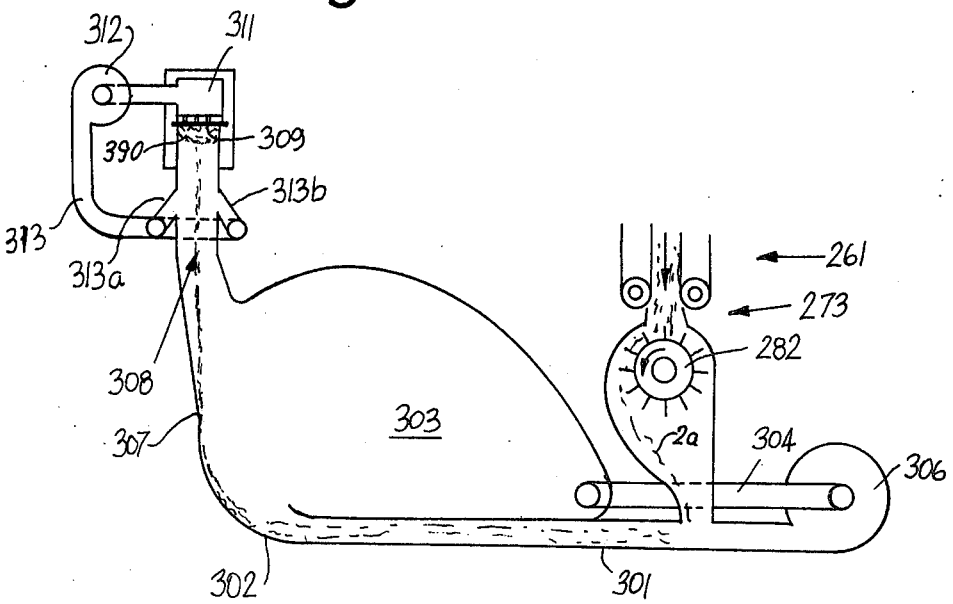
* and FIG. 5 is a schematic partly elevational and partly vertical sectional view of a portion of a second apparatus.

FIG. 5 shows a portion of a modified apparatus. This portion replaces the apparatus portion of FIG. 1b. The parts 261, 273 and 282 are respectively analogous to or identical with the parts 61, 73 and 82 of the apparatus of FIGS. 1*a*–1*b*.

The needles of the wheel 282 propel tobacco particles 2*a* into a horizontal pneumatic conveyor pipe 301 which receives a current of air from the outlet of a blower 306 and advances the particles 2*a* against a baffle or an analogous deflector 302 before the particles enter a relatively large expansion chamber 303 having an outlet which is connected to the intake of the blower 306 by a conduit 304. The particles 2*a* travel along the concave inner side of the baffle 302 and leave such inner side at a locus 307 where the baffle exhibits a pronounced edge. The kinetic energy of particles 2*a* suffices to cause them to rise in the form of a narrow shower and to form a growing tobacco stream at the underside of the lower reach of a narrow foraminous belt conveyor 309 which, by analogy, can be called a functional equivalent of the conveyor 84. The lower reach of the conveyor 309 is disposed at the upper end of an upright channel 308 and the upper side of this lower reach is located below the open underside of a suction chamber 311. The channel 308 can be said to correspond to the trough 89 of FIG. 1*b*. It will be noted that the particles 2*a* rise in the central portion of the channel 308 on their way toward the lower reach of the conveyor 309.

The suction chamber 311 is connected with the intake of a suction generating device 312 (e.g., a blower or fan) whose outlet is connected with a pipe 313 having upwardly oriented branches 313*a*, 313*b* serving to direct ascending currents of air toward the underside of the lower reach of the conveyor 309. Such currents assist the upward movement of particles 2*a* into the stream growing zone. Moreover, such currents assist the suction chamber 311 by insuring that the growing tobacco stream 309 adheres to and advances with the conveyor 909.

The apparatus which embodies the structure of FIG. 5 is somewhat simpler than the apparatus of FIGS. 1*a* and 1*b*. The decision whether to use the apparatus of FIGS. 1*a* and 1*b* or 1*a* and 5 will depend, to a certain degree, on the dimensions of the space which is available for the distributor in a cigarette maker or an analogous machine serving to convert particles of tobacco and wrapping material into a continuous rod which can be subdivided into discrete sections constituting plain cigarettes, cigarillos or cigars.

An important advantage of the improved apparatus is that the particles of tobacco are treated gently. The apparatus need not employ any picker rolls, winnowers and/or other devices which are likely to reduce the size of particles 2*a* and to produce large quantities of tobacco dust.

Another important advantage of the improved apparatus is that the wheel 82 or 282 invariably receives and advances identical quantities of tobacco particles 2*a* per unit of time so that the apparatus can build a tobacco stream 90 or 390 with a surprisingly high degree of reproducibility. This enhances the quality of the finished products and reduces the need for the use of trimming or equalizing devices downstream of the stream growing zone. It has been found that the quality of the laminated stream 90 which is obtained in the apparatus of FIGS. 1*a*, 1*b* is especially satisfactory.

A further important advantage of the improved apparatus is that the number of moving parts is relatively small and that its space requirements need not exceed (and are normally less than) the space requirements of conventional distributors.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. Apparatus for producing a continuous tobacco stream, comprising a source of tobacco particles; a duct; means for continuously transporting particles from said source into said duct whereby said duct accumulates an intermediate supply of particles; means for condensing successive increments of said intermediate supply, including first conveyor means having a rotary member and means for transmitting to said member a substantially constant torque so that the speed of said member is a function of the quantity of tobacco in successive increments; means for receiving condensed particles from said condensing means, including a plurality of endless flexible elements defining a first passage for condensed particles and arranged to advance such particles in a predetermined direction, said first conveyor means comprising two endless flexible elements disposed opposite each other and defining a second passage wherein the condensed particles travel toward and into said first passage; stream forming means including second conveyor means; means for transferring particles from said receiving means to said stream forming means; and means for driving said second conveyor means and said flexible elements of said receiving means independently of said first conveyor means.

2. Apparatus as defined in claim 1, wherein said duct is an upright duct and said intermediate supply forms a column of tobacco particles, said condensing means being disposed below said duct.

3. Apparatus as defined in claim 1, wherein said transferring means comprises means for loosening the particles issuing from said first passage and third conveyor means for transporting loosened particles to said stream forming means.

4. Apparatus as defined in claim 1, wherein the flexible elements of said first conveyor means include elongated portions having first sides which engage the particles in said second passage and second sides, said condensing means further comprising back supports adjacent the second sides of said elongated portions.

5. Apparatus as defined in claim 4, wherein said back supports comprise groups of rolls.

6. Apparatus as defined in claim 1, wherein said torque transmitting means comprises motor means and an electric clutch between said motor means and said rotary member.

7. Apparatus as defined in claim 1, wherein said transporting means comprises further conveyor means having means for withdrawing particles from said source and variable-speed motor means fo said further conveyor means, and further comprising means for monitoring the quantity of particles in said duct and means for changing the speed of said motor means when the monitored quantity of particles in said duct deviates from a predetermined range of quantities.

8. Apparatus as defined in claim 1, wherein said source contains a mixture of lighter and heavier particles and said transporting means comprises third conveyor means having means for withdrawing particles from said source, a pneumatic conveyor having an inlet for the particles which are withdrawn by said third conveyor means and an outlet, means for classifying the particles issuing from said outlet according to weight, and means for admitting lightweight particles into said duct.

9. Apparatus as defined in claim 8, wherein said classifying means comprises a chamber and further comprising means for evacuating heavier particles from said chamber.

10. Apparatus as defined in claim 9, wherein said pneumatic conveyor includes a pipe having an elbow which constitutes said outlet, said chamber having an air outlet which is remote from said duct.

11. Apparatus as defined in claim 10, wherein said pneumatic conveyor further comprises an air circulating device having an intake connected with the air outlet of said chamber and an outlet connected with said pipe upstream of said inlet.

12. Apparatus as defined in claim 8, wherein said duct is an upright duct having an open upper end and said admitting means comprises a conveyor having a discharge end located above the upper end of said duct.

13. Apparatus as defined in claim 1, wherein said passage has a discharge end and said transferring means comprises a rotary member having projections arranged to orbit along a path having a portion adjacent said discharge end to loosen successive increments of tobacco issuing from said receiving means.

14. Apparatus as defined in claim 1, wherein said transferring means comprises a plurality of pneumatic conveyors each having an inlet for reception of tobacco particles from said receiving means and an outlet adjacent said stream forming means, said inlets forming a row of closely adjacent inlets, said outlets of said pneumatic conveyors being staggered with respect to each other, as considered in the direction of movement of said second conveyor means.

15. Apparatus as defined in claim 14, wherein said transferring means further comprises an elongated rotary element having projections arranged to entrain tobacco particles issuing from said first passage and said row of inlets is adjacent to and parallel with said rotary element.

16. Apparatus as defined in claim 14, wherein said pneumatic conveyors include elongated pipes and said outlets constitute arcuate portions of the respective pipes wherein tobacco particles are segregated from air by centrifugal force.

17. Apparatus as defined in claim 16, wherein said stream forming means further comprises an elongated trough and said second conveyor means includes a portion which constitutes the bottom wall of said trough, said outlets being positioned to discharge particles of tobacco into said trough.

18. Apparatus as defined in claim 14, further comprising a common source of compressed air for said pneumatic conveyors, said last mentioned source having an outlet in communication with said pneumatic conveyors and an intake, said pneumatic conveyors including pipes each having a portion located downstream of the respective first mentioned outlet and communicating with said intake.

19. Apparatus as defined in claim 18, wherein said second conveyor means comprises a foraminous belt conveyor including an elongated portion having a first side which receives tobacco particles from the outlets of said pipes and a second side, said stream forming means further comprising a suction chamber at said second side of said elongated portion and a pipe connecting said suction chamber with said intake.

20. Apparatus as defined in claim 14, wherein each of said pneumatic conveyors comprises a pipe having a rectangular outline in the region of the respective inlet and a substantially square outline in the region of the respective outlet, said rectangular outline merging gradually into said square outline and the cross-sectional area of each of said pipes being constant between the respective inlets and outlets.

21. Apparatus as defined in claim 20, wherein said stream forming means further comprises a trough having a bottom wall constituted by said second conveyor means and the outlets of said pipes extend into said trough.

22. Apparatus as defined in claim 1, wherein the cross-sectional area of said second passage is less than the cross-sectional area of said duct.

23. Apparatus for producing a continuous tobacco stream, comprising a source of tobacco particles; a duct; means for continuously transporting particles from said source into said duct whereby said duct accumulates an intermediate supply of particles; means for condensing successive increments of said intermediate supply, including first conveyor means having a rotary member and means for transmitting to said member a substantially constant torque; means for receiving condensed particles from said condensing means, including a plurality of endless flexible elements defining a first passage for condensed particles and arranged to advance such particles in a predetermined direction, said first conveyor means comprising two endless flexible elements disposed opposite each other and defining a second passage wherein the condensed particles advance toward and into said first passage, the cross-sectional area of said second passage being less than the cross-sectional area of said first passage; stream forming means including second conveyor means; means for transferring particles from said receiving means to said stream forming means; and means for driving said second conveyor means and said flexible elements of said receiving means independently of said first conveyor means.

* * * * *